US008028374B2

(12) United States Patent
Lang

(10) Patent No.: US 8,028,374 B2
(45) Date of Patent: Oct. 4, 2011

(54) FURNITURE GLIDE PROTECTIVE DEVICES

(76) Inventor: Albert J. Lang, Landing, NJ (US)

( * ) Notice: Subject to any disclaimer, the term of this patent is extended or adjusted under 35 U.S.C. 154(b) by 693 days.

(21) Appl. No.: 12/011,073

(22) Filed: Jan. 24, 2008

(65) Prior Publication Data

US 2008/0209686 A1 Sep. 4, 2008

Related U.S. Application Data

(60) Provisional application No. 60/897,365, filed on Jan. 25, 2007.

(51) Int. Cl.
*A47B 91/06* (2006.01)

(52) U.S. Cl. ..... 16/42 R

(58) Field of Classification Search ..... 16/42 R, 16/42 T, 18 CG; 248/188.8, 188.9, 346.11, 248/345.1, 188.7
See application file for complete search history.

(56) References Cited

U.S. PATENT DOCUMENTS

| | | | | |
|---|---|---|---|---|
| 1,903,609 | A | 4/1933 | Uhi | |
| 2,326,422 | A * | 8/1943 | Weisberger | 2/59 |
| 2,799,287 | A | 7/1957 | Wagner | |
| 2,865,133 | A | 12/1958 | Hoven et al. | |
| 4,964,430 | A | 10/1990 | Janis | |
| 5,081,740 | A * | 1/1992 | Smith | 16/42 R |
| 5,377,710 | A | 1/1995 | Laser | |
| 6,164,306 | A | 12/2000 | Townsend | |
| 6,206,424 | B1 * | 3/2001 | Edwards et al. | 280/845 |
| 6,324,725 | B1 | 12/2001 | Green | |
| 6,405,982 | B2 | 6/2002 | Ferencz | |
| 6,527,001 | B1 | 3/2003 | Saldan et al. | |
| 6,647,589 | B1 | 11/2003 | Youngwith | |
| 6,669,221 | B2 | 12/2003 | Leppke et al. | |
| 6,754,934 | B1 | 6/2004 | Shiffler | |
| 6,802,482 | B2 | 10/2004 | Harris | |
| 6,869,052 | B2 | 3/2005 | Keast et al. | |
| 7,124,986 | B1 | 10/2006 | Bailey | |
| 2005/0081330 | A1 * | 4/2005 | Edwards | 16/42 R |
| 2005/0183234 | A1 | 8/2005 | Bushey et al. | |
| 2005/0266755 | A1 | 12/2005 | Poirier | |
| 2006/0053587 | A1 | 3/2006 | Chase | |
| 2007/0186374 | A1 * | 8/2007 | Thaw et al. | 16/42 R |
| 2008/0042025 | A1 * | 2/2008 | Brouard et al. | 248/188.9 |
| 2008/0116331 | A1 * | 5/2008 | Deaner | 248/188.9 |

* cited by examiner

*Primary Examiner* — Chuck Y. Mah
(74) *Attorney, Agent, or Firm* — Dara L. Onofrio, Esq.; Onofrio Law

(57) ABSTRACT

A furniture glide protective device comprised of a laminated material comprised of an exterior surface made of synthetic fibers, a middle neoprene portion, and an interior surface made of nylon web meshing; wherein said laminated material is tubular-shaped having an opening on one end for insertion on the furniture leg and a surface on the opposite end to protect the floor; and a fastening mechanism for securing and locking said tubular shaped material over the furniture glide on the leg of a chair and/or table; and related method for securing a furniture glide and protecting a floor surface from scratching by furniture.

14 Claims, 5 Drawing Sheets

FURNITURE GLIDE PROTECTIVE DEVICES

This application claims the benefit of U.S. provisional application No. 60/897,365 filed Jan. 25, 2007, which is incorporated herein in its entirety by reference.

FIELD OF THE INVENTION

The present invention relates to attachments for furniture, such as chair and/or table legs, which are used to protect the surface underneath. In particular the invention relates to devices that cover glides on the furniture leg and are securely attached to further protect the floor surface.

BACKGROUND OF THE INVENTION

The general disclosure of various chair devices used to protect a floor surface are known in the prior art. Representative patents are listed below.

U.S. Pat. No. 1,903,609 to Uhl discloses a chair glide in FIGS. 1 and 6 comprising a cup shaped body 1 made of rubber or elastic material having a bottom plate 4 made of steel that is attached to an embedded anchoring disc 5 (see FIG. 5). The glide is manufactured by molding the material of the cup around the glide embedded disc. The neck portion of the glide is elastic and the glide is attached to the furniture by stretching the elastic portion.

U.S. Pat. No. 2,799,287 to Wagner discloses an anti-slipping attachment for the bottom of crutches that is attached to the crutch with a strap 19 that is trained around the upper ends of arms 13, 15 with pegs extending through holes in the strap, with the strap being secured to its buckle. (See FIGS. 1-3 and col. 2, lines 39-44). The strap 19 can be easily opened.

U.S. Pat. No. 2,865,133 to Hoven et al. discloses a plastic or rubber foot 13 for a furniture leg in FIG. 4 with a toroidal cavity 16 with a restricted opening 17 extending from the cavity to the bottom of the furniture leg. The rubber foot 13 is assembled by forcing the furniture leg 14 through restricted opening 17.

U.S. Pat. No. 4,964,430 to Janis discloses an apparatus for attaching to a walking cane to prevent slippage. The device is attached to the bottom of the cane in FIGS. 1 and 2 with an adjustable strap 5 by a conventional nut and bolt assembly or an externally threaded member or matching slots (col. 3 lines 1-14). FIG. 9 is connected with bolts that can be threaded into a nut and threaded orifice.

U.S. Pat. No. 5,377,710 to Laser discloses a temporary crutch tip assembly for preventing lateral slippage of ground. The engaging tip of the crutch comprises a stud plate with a plurality of sharp teeth projecting downwardly perpendicularly to the stud plate, said plate having a diameter corresponding to outside diameter of the crutch tip and surrounding straight wall sections defining a cup shaped receptacle for the crutch tip. The plate is attached to the crutch by two resilient flexible bands securing the plate to the crutch.

U.S. Pat. No. 6,164,306 to Townsend discloses an attachment to crutches, canes and other walking devices for primary use in soft terrain. A pad of several layers of flexible material is adhered together with adhesives. The pad is attached to crutches and canes by an adjustable strap system having side straps stitched to the top of the pad and an adjustable strap attached to the top of the side straps and being attachable to itself and having a grip tab for easy attaching and detaching.

U.S. Pat. No. 6,324,725 to Green discloses a furniture glide 16 comprising an upper portion 18 of a generally tubular shape for fitting over the bottom of a chair leg made of steel and a lower portion 20 attached to the upper portion and having a bottom surface 22 containing a plurality of stipples 24 (hemispherical or cubic or rectilinear shaped protrusions). The patent also discloses in FIG. 3 a replacement chair glide 16 containing a rim 30 that fits over the rim 36 of existing chair glide. This patent also describes the method of repairing an article of furniture having a defective glide comprising (a) forming a cap with a bottom surface and an inner surface opposed to said bottom surface and (b) attaching the cap to the defective glide whereby the inner surface of the cap contacts the bottom surface of the defective glide and the bottom surface of the cap contacts the floor.

U.S. Pat. No. 6,405,982 to Ferencz discloses a self attaching sliding support 10 for elastic engagement with a leg of an article to be supported comprising (a) and elastomeric element 12 having a base portion 16 and a circumferential inwardly extending rim 18 defining a cup-shaped cavity and (b) a second cup shaped, sliding element 14 made of low friction plastic or metal that is joined to the bottom of the elastomeric element 12. According to Col. 2 lines 6-10, the rim 18 of the elastomeric element 12 elastically engages the leg of the chair and is capable of accommodating legs of various sizes and shapes. As described the sliding support is easily removable.

U.S. Pat. No. 6,527,001 to Saldan et al. discloses a stabilizing cane attachment 10 in FIGS. 1, 2 and 3 that comprises a conically shaped support member 11 having a bore 13 extending there through a first stopper comprising a hose clamp with a fastening member 17 mounted above the support member 11 and second stopper member 18 made of rubber adapted to mount over the bottom end of the cane 26 to attach the cane attachment 10 to the bottom end of the cane 26 comprising a bottom 19 with a bore 20 extending through the top of said second stopper and an annular groove 22 containing washer member 21 at the bottom of the bore 20.

U.S. Pat. No. 6,669,221 to Leppke et al. discloses an apparatus attachable to a motorcycle kickstand having a base plate to prevent the kickstand from sinking into the ground. The stand comprises a supporting pad 2 with a diameter preferably 2-3 times the diameter of the base plate preferably made of reinforced rubber with one, preferably two, flexible supporting tabs 3 and 3' being bendable to about the leg of the kickstand and being fastened to the leg with a tightener band 12. The tightener band comprises any suitable looped device that may be tightened and locked, e.g. a toothed nylon strip and ratchet clasp or a conventional screw actuated metal strip hose clamp as seen in FIG. 6. (Col. 4, lines 1-66).

U.S. Pat. No. 6,754,934 to Shiffler discloses in FIGS. 1-5 a floor engaging, generally circular cap 100 made of injection-molded polypropylene that attaches to a furniture leg that has a generally planar lower surface 110 and upper surface 120 that cooperates with a cylindrical sidewall 130 to form a cup shaped receptacle that is adapted to receive a furniture leg. Lower surface 110 has a plurality evenly spaced outer protrusions 140 with a height H1 and an evenly spaced plurality inner protrusions 150 with a height H2 that is less than the height of H1. In a further preferred embodiment there are eight outer protrusions and four inner protrusions with the inner protrusions being connected to the outer protrusions by a saddle 162 with height H3 that is less than H2. The outer and inner protrusions 140, 150 and saddles 162 define channels to provide paths for dirt and debris to pass through as a chair is moved across the floor. A method of repairing furniture is also described as having a glide for contacting the floor comprising installing the above-defined glide on the leg of the chair.

U.S. Pat. No. 6,802,482 to Harris discloses in FIGS. 1-3 a cuplike overboot 24 for increasing the foot print of the foot portion of a bi-pod firearm support 22. FIGS. 2 and 3 illustrate a cylindrical wall 42 integrally formed with a toroidal base 44 in the shape of a truncated cone having a circular foot portion 46 integrally formed with a cone portion 48 consisting of a plurality of concentric ribs 60 having an outside ring 58 and an annular flange 54 that define the recess 62 and a band 64 that when tightened around the support 22 hold overboot 24 in place. The overboot 24 is made from flexible material such as rubber and are held in place by a band made of pliant material such as rubber that can be tightened and untightened.

U.S. Pat. No. 6,869,052 to Keast et al. discloses in FIGS. 1-4 a replaceable floor protector assembly 10 having a main body portion 11 that is threaded on its outer periphery 21 with a central hole 107 and two spaced holes 103 and 104 that is joined to the chair or table with a nail 12 and two spaced prongs 101 and 102. A floor protector 14 having an upper flange portion 16 and an integral downwardly extending floor protector portion 15 made of soft, rigid material, e.g. felt, is held in place by a circular retainer 17 that is threaded on its upper interior to attach to the main body portion 11 with the floor protector 14 element forming the bottom patent.

U.S. Patent Publication No. 2005/0183234 to Bushey et al. describes a pliable furniture glide 1 in FIG. 3 having a pliable retention boot 1a having an upper cavity 10 for receiving a foot 5 of a furniture leg 4 containing a nut 12 that the user can adjust the vertical spacing between the foot 5 and a bottom surface of the furniture leg. FIG. 2 shows the retention boot 1a has an upper portion 17 that defines the opening 21 of the upper cavity 10 and bottom portion of the cavity includes a thickened bottom portion 23 with the bottom of the thickened portion bonded to the upper surface of a felt disk 2 the bottom of which is bonded to the upper surface 3a of felt disk 3 whose bottom surface is in contact with the floor. This chair glide is installed by pressing over the foot of a chair leg and is removable.

U.S. Patent Publication No. 2006/0053587 to Chase discloses a furniture glide assembly 10 that is adapted to be removably mounted to the free end 16 of the chair leg 14 comprising a substantially spherical body 20 defining a coaxial bore 22 extending partially through the body 21 and an insert 28 that is adapted to contain the free end 16 of the chair leg 14 disposed and retained in said bore 22 through a ring and groove combination (FIGS. 2-4) or groove formed by a post 154 and sidewall combination (FIGS. 5-7) or by an insert 228 defining a post 254 and passageway 242 (FIGS. 8-10). The floor engaging portion has a round ball shape.

In general, known chair glides although used to protect a floor surface are deficient in that some of the devices actually scratch the floors and others are easily removable. It is known that schools have resorted to using tennis balls to keep chair glides from scratching the surface floors. As described in the patents above, felt stick on pads and special nylon caps with felt will only work on some glides and are not permanent. The present invention provides an advantage over known devices in that the specific construction of the invention device will not snap off and is permanent. The device is a laminated material made of an exterior surface of synthetic fibers a middle layer of neoprene rubber and an interior surface of a nylon web meshing. The material is either seamless or with a seam and in a tubular form which is stretched over the glide. The material is held in place with a locking tie making the application permanent.

The invention can be used on a variety of furniture both for the home as well as on outside deck furniture. In schools and institutions a preferred use of the device is on chairs, desks and tables. In homes preferred use of the device is on furniture in kitchens and dining rooms.

Another advantage over the prior art is when sand and grit accumulates under the furniture glide, the invention device will absorb the grit and sand into the synthetic felt and neoprene material and the floor will not be scratched.

Yet a further object of the invention is where the constrictive locking mechanism will not permit and individuals, particularly a student's, removal.

Another object of the invention is the flexibility of the invention glide permitting easy application to furniture legs of a variety of diameter sizes.

Yet another object of the invention is to provide a "one-size" fits all device that stretches over a variety of different size furniture glides.

In another embodiment a circular shaped rubber material with a plurality of arms, preferably four, each arm having a slit which is threaded with a fastening mechanism. This embodiment provides the same advantages over the prior art as discussed above.

SUMMARY OF THE INVENTION

In the present invention, these purposes, as well as others which will be apparent, are achieved generally by providing a furniture glide protective device comprised of a laminated material comprised of an exterior surface made of synthetic fibers, a middle neoprene portion, and an interior surface made of nylon web meshing. The laminated material is tubular-shaped having an opening on one end for insertion on the furniture leg and a surface on the opposite end to protect the floor and a fastening mechanism for securing and locking the tubular shaped material over a chair glide on the leg of a chair and/or table. The tubular shaped material can be seamless or with seams and is stretched over the furniture leg to be protected. The device is flexible enough that when stretched over the furniture glide it stays in place without having to be held in place by the installer. Because of the flexibility of the device it can fit a variety of different size furniture glides, thus providing a "one-size" fits all device.

The fastening mechanism is preferably a nylon or wire constriction tie and permanently locks and secures the tubular shaped material in place.

The exterior surface is made of synthetic fibers selected from the group consisting of nylon, polypropylene, felt and other synthetic fibers.

In an alternate embodiment of the invention, the laminated material may further include at least one slit to thread the fastening mechanism to assist in attaching the invention device to the furniture leg.

The invention also provides a method for securing a furniture glide and protecting a floor surface from scratching by furniture comprising the steps of providing the furniture glide protective device according to the invention and applying the device over each leg of the furniture. The device is secured and locked using the fastening mechanism to permanently hold said device in place to protect the floor surface.

The protective device of the invention can be applied to furniture such as tables, chairs, end tables both for exterior (outside) use or inside the home. More specifically they can be used on deck furniture, in schools and institutions of desks, chairs and tables and in homes in kitchen and dining rooms.

In an alternate embodiment a chair glide protective device is provided comprised of a circular shaped rubber material with a plurality of arms wherein each of said arms has a slit. Preferably the device has four arms. A fastening mechanism is threaded within each slit and pulled tight to lock the device in place over the chair glide.

Other objects, features and advantages of the present invention will be apparent when the detailed description of the preferred embodiments of the invention are considered with reference to the drawings, which should be construed in an illustrative and not limiting sense.

DETAILED DESCRIPTION OF THE INVENTION

Figure 1A:
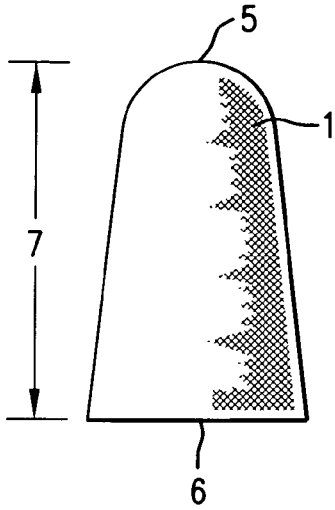
FIG. 1A is an illustration of the invention device without a seam.
Figure 1B:
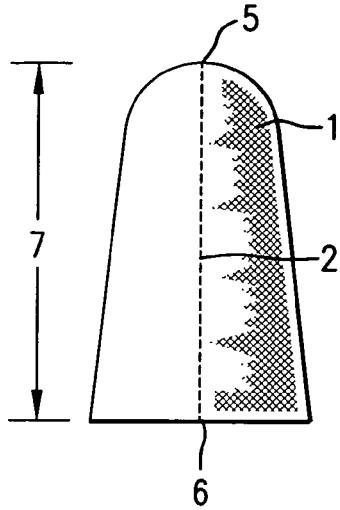
FIG. 1B is an illustration of the invention device with a seam.

In accordance with the present invention devices attachments for chair and/or table legs used to secure a furniture glide and to protect the floor surface are provided. As described in the accompanying drawings the structures of the invention device are labeled as follows:

1—Exterior Surface
2—Seam
3—Neoprene
4—Interior Surface
5—Exterior floor surface portion
6—Furniture leg portion edge
7—Device length
8—Opening for furniture leg
10—Invention device
11—Furniture Glide
12—Furniture Leg
13—Nylon or wire construction tie
14—Fastening mechanism
15—Circular shaped rubber material with four arms (alternate embodiment)
16—Slits In general, FIGS. 1A and 1B represent illustrations of the furniture glide protective device of the invention, without a seam and with a seam, respectively.

The device is made of a laminated material comprised of an exterior surface made of synthetic fibers 1, a middle neoprene portion 3, and an interior surface made of nylon web meshing 4; wherein said laminated material is tubular-shaped having an opening 6 on one end for insertion on the furniture leg and a surface on the opposite end 5 to protect the floor. A fastening mechanism is used for securing and locking the tubular shaped material over the furniture glide on the leg of a chair and/or table.

Figure 2A:
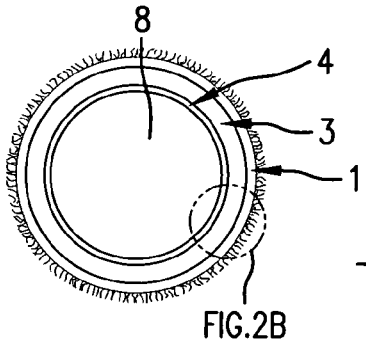
FIG. 2A is a cross section of the invention device.
Figure 2B:
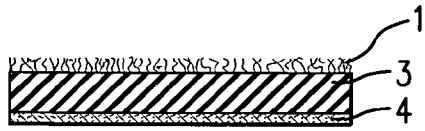
FIG. 2B is an expanded illustration of the laminated material of the invention device.

FIGS. 2A and 2B, respectively, illustrate a cross section of the invention device and an expanded illustration of the laminated material.

The exterior surface is made of a thin layer of protective material, preferably synthetic fibers. The synthetic fibers are selected from the group consisting of polypropylene, felt, nylon or other synthetic fibers. A portion of the exterior surface material comes in contact with the floor surface. The middle portion of the laminated material is neoprene and is preferably ⅛" to ¼" inch thick.

The interior nylon web meshing remains in contact with the furniture leg. The thickness of the inner material ranges from 7 mm to ¼" of an inch, in thin applications the inner material ranges from 7 mm to 1/16 of an inch. The inner material provides structure and durability to the invention device as well as providing flexibility.

Other materials that can be used as the inner material include nitrile rubber, synthetic and natural isoprene rubber, butadiene rubber, EPM, EPDM, butyl rubber, styrene-butadiene rubber can also be used in the invention device.

In FIG. 1A the device is one piece of material without a seam and FIG. 2 two pieces of the laminated material are stitched together and form a seam. Although the preferred material is a seamless tube, if a seam is present, the integrity of the device is not compromised. It is understood that the thicker the material the more durable the device will be.

The opening 8 preferably has a diameter in the range of 1¼" to 2" inches wide. The surface on the opposite end 5 of said opening has a diameter in the range of ¾" to 1" inch wide. The length 7 of the laminated material is between 2" to 2½" inches long. Although preferred dimensions are described this is not intended to limit the invention to such, as other dimensions are included within the scope of the invention.

Figure 3:
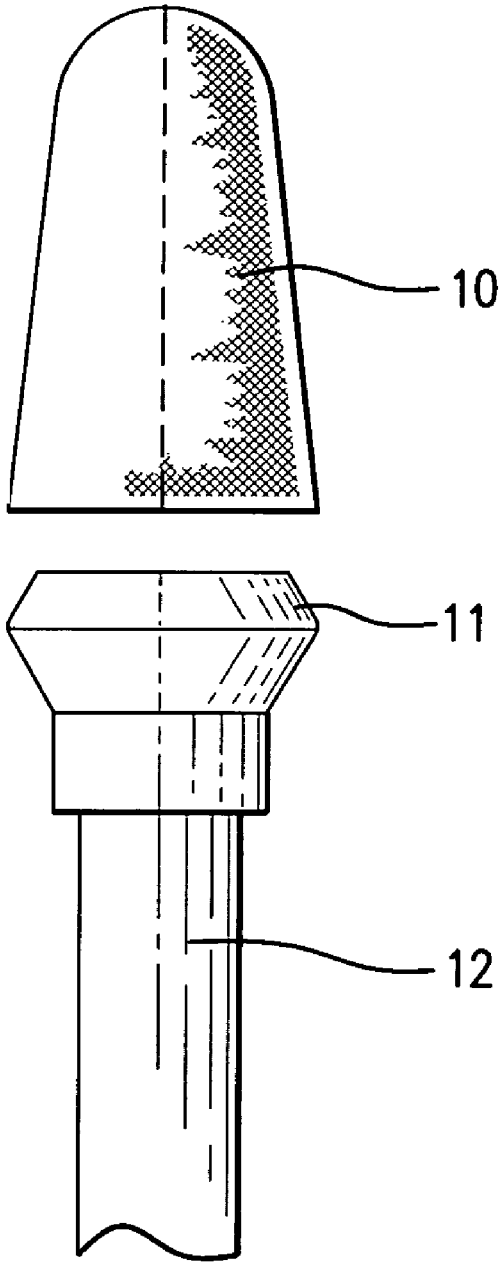
FIG. 3 is an illustration of the invention device prior to placement over the furniture glide. The device is pulled over the furniture glide and held in place by the fastening mechanism (not shown here)

FIG. 3 illustrates the invention device 10 prior to placement over a furniture glide 11 attached to a furniture leg 12. The cylindrical or tubular shaped material is pulled over the furniture glide and held in place by the fastening mechanism (not shown here). In an alternate embodiment the invention device can be used over the furniture leg without the presence of a chair glide. In this embodiment the security of the device may be slightly diminished since the presence of that chair glide provides extra stability to keep the device in place.

The invention material can stretch to fit many size furniture glides and furniture legs. The flexibility of the invention glides permit easy application to furniture legs of a variety of diameter sizes. The device is stretched over the furniture glide and because of it's flexibility it stays in place without further assistance from the installer. Once the device is in place, the fastening mechanism, preferably a strong nylon tie or wire tie, is held in place and locked.

An optional feature of the invention is in the provision of at least one slit on the laminated material to thread the fastening mechanism. This feature is optional since as described above once the device is stretched over the furniture glide it fits snugly and the fastening mechanism can easily be tied.

Figure 4A:
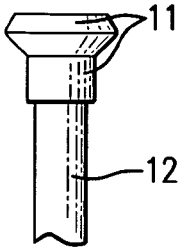
FIGS. 4A to 4E illustrate the steps in applying the invention device to a furniture leg.
Figure 4B:
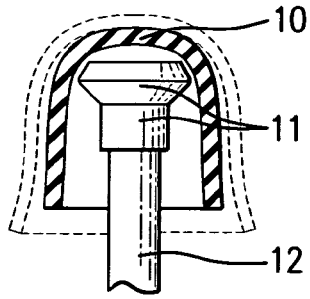
Figure 4C:
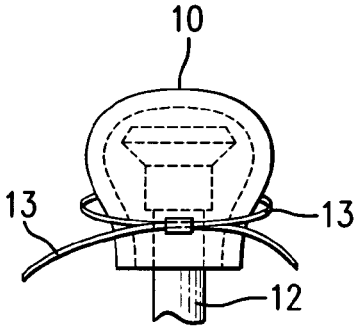
Figure 4D:
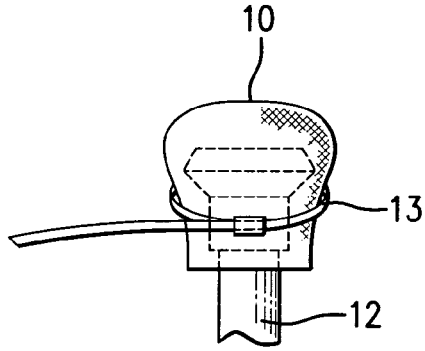
Figure 4E:
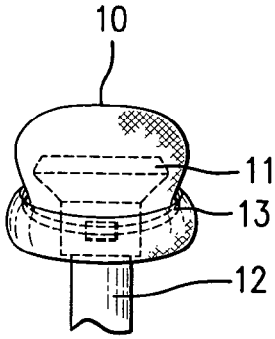

FIGS. 4A TO 4E illustrate the steps in applying the invention device to a furniture leg. FIG. 4A shows a furniture leg 12 with attached furniture glide 11. FIG. 4B illustrates the invention device 10 placed on top of the furniture glide 11. The device is flexible and is stretched over glide to fit snugly and stays in position without further assistance from the installer. In FIG. 4C the fastening mechanism 13 which is preferably a nylon or wire construction tie is placed around the invention device a short distance from the edge 6 leaving a flange portion above the tie. In FIG. 4D the tie 13 is pulled tight to secure the invention device to the furniture leg 12. Excess material of the tie can be cut off and the remaining portion, the flange, of the device above the tie is folded over to conceal the tie underneath. FIG. 4E.

Figure 5:
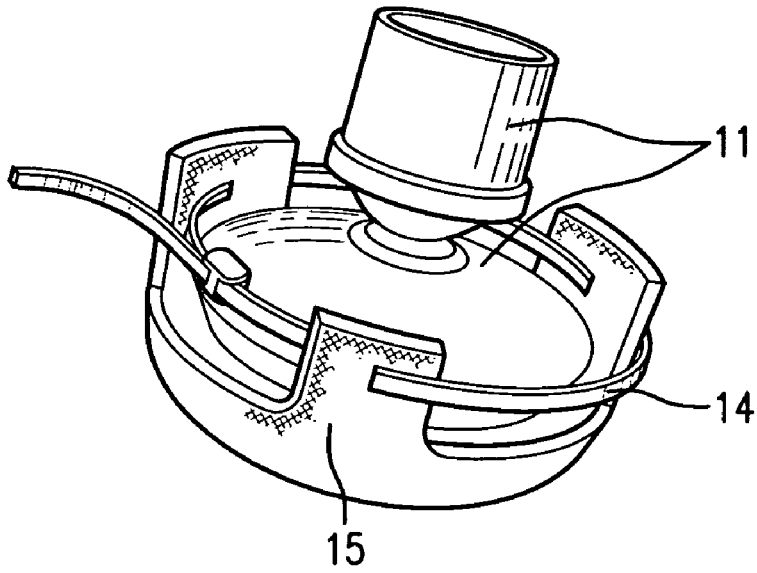
FIG. 5 is an illustration of an alternate embodiment of the invention.

FIG. 5 is an illustration of an alternate embodiment of the invention in which a circular shaped rubber material with a plurality of arms 15, preferably four, each arm having a slit which is threaded with a fastening mechanism 14 is placed over a furniture glide 11.

Other materials such as nitrile rubber, synthetic and natural isoprene rubber, butadiene rubber, EPM, EPDM, butyl rubber, styrene-butadiene rubber can also be used in the invention device.

Figure 6:
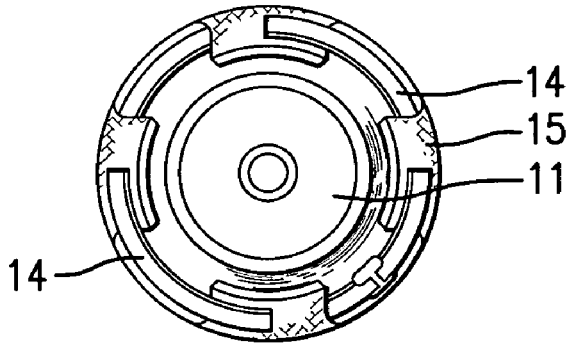
FIG. 6 is a bottom view of the alternate embodiment of the invention where the fastening mechanism is locked.

FIG. 6 is a bottom view of the alternate embodiment of the invention where the fastening mechanism 14 is locked holding the rubber material 15 securely in place over the furniture glide 11.

Figure 7:
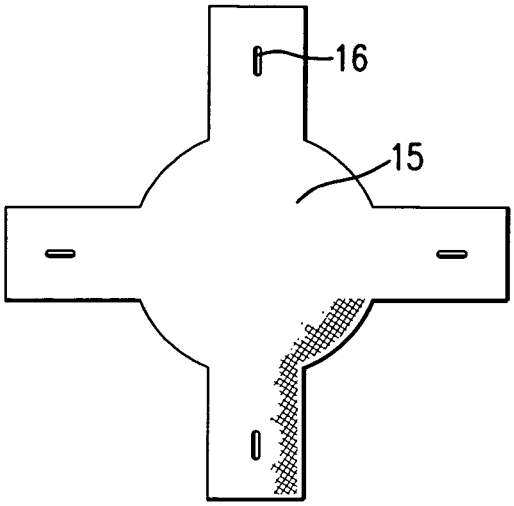
FIG. 7 shows an alternate embodiment of the invention illustrating a circular shaped rubber material with a plurality of arms.

FIG. 7 is a view of an alternate embodiment of the invention illustrating a circular shaped rubber material 15 illustrating four arms with slits 16 for threading the fastening mechanism.

Figure 8:
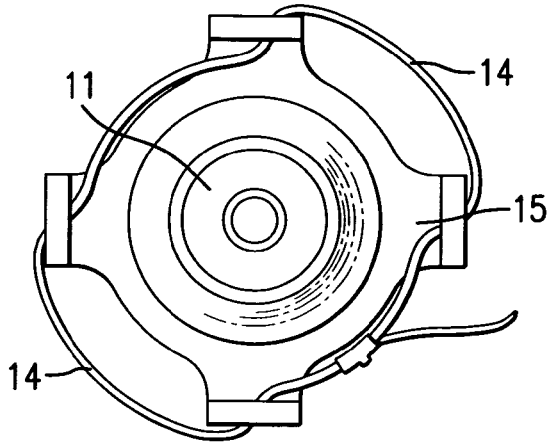
FIG. 8 is a bottom view of the alternate embodiment of the invention where the fastening mechanism is threaded.

FIG. 8 is a bottom view of the alternate embodiment of the invention where the fastening mechanism 14 is threaded thru the slits 16.

Figure 9:
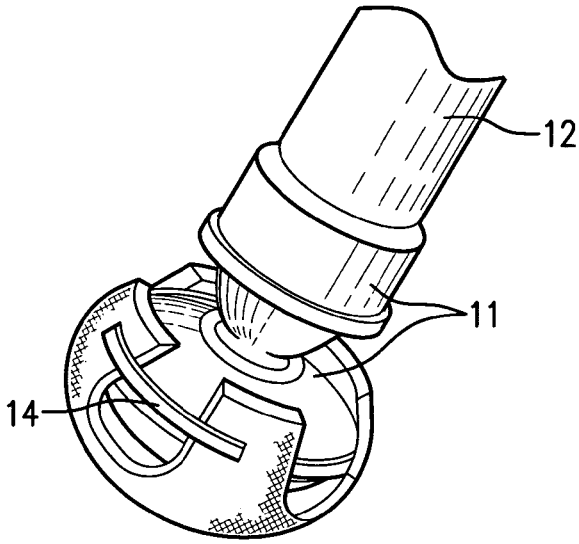
FIG. 9 is an illustration of the alternate embodiment of the invention where the device is secured over a chair glide.

FIG. 9 is an illustration of the alternate embodiment of the invention where the device is secured over a furniture glide 11 attached to a furniture leg 12.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A furniture glide protective device comprised of:

a laminated material comprised of an exterior surface made of synthetic fibers, a middle neoprene portion, and an interior surface made of nylon web meshing;

wherein said laminated material is tubular-shaped having an opening on one end for insertion on the furniture leg and a surface on the opposite end to protect the floor; and a fastening mechanism for securing and locking said tubular shaped material over the furniture glide on the leg of a chair or table.

2. The device according to claim 1, wherein said fastening mechanism is a nylon or wire constriction tie.

3. The device according to claim 1, wherein said fastening mechanism permanently locks and secures said tubular shaped material in place.

4. The device according to claim 1, wherein said exterior surface is made of synthetic fibers selected from the group consisting of nylon, polypropylene and felt.

5. The device according to claim 1, wherein the tubular material is seamless.

6. The device according to claim 1, wherein the tubular material is two pieces and has a seam to securely hold said pieces together.

7. The device according to claim 1, wherein said opening has a diameter in the range of 1¼" to 2" inches wide.

8. The device according to claim 1 wherein said surface on the opposite end of said opening has a diameter in the range of ¾" to 1" inch wide.

9. The device according to claim 1, wherein the length of said tubular shaped material is between 2" to 2½" inches long.

10. The device according to claim 1, wherein said neoprene is between ⅛" to ¼" inch thick.

11. The device according to claim 1, wherein said laminated material further has at least one slit to thread said fastening mechanism.

12. A method for securing a furniture glide and protecting a floor surface from scratching by furniture comprising the steps of:

providing a furniture protective device comprised of a laminated material having an exterior surface made of synthetic fibers, a middle neoprene portion, and an interior surface made of nylon web meshing; wherein said laminated material is tubular-shaped having an opening on one end for insertion on the furniture leg and a surface on the opposite end to protect the floor; and a fastening mechanism for securing and locking said tubular shaped material over the furniture glide on the leg of a chair or table;

applying said device over each leg of the furniture; and securing and locking the fastening mechanism to permanently hold said device in place over the furniture glide and to protect the floor surface.

13. The method according to claim 12, wherein the furniture is a table, chairs, end tables, deck furniture, desks.

14. A furniture glide protective device comprised of:

a laminated material comprised of an exterior surface made of felt, a middle neoprene portion, and an interior surface made of nylon web meshing; wherein said laminated material is tubular-shaped having an opening on one end for insertion on the furniture leg and a surface on the opposite end to protect the floor; and a fastening mechanism for securing and locking said tubular shaped material over the furniture glide on the leg of a chair or table.

* * * * *